US012606971B1

(12) United States Patent
Foster

(10) Patent No.: US 12,606,971 B1
(45) Date of Patent: Apr. 21, 2026

(54) GROUND ANCHOR AND ADAPTER SYSTEM

(71) Applicant: Fred Wayne Foster, Granbury, TX (US)

(72) Inventor: Fred Wayne Foster, Granbury, TX (US)

( * ) Notice: Subject to any disclaimer, the term of this patent is extended or adjusted under 35 U.S.C. 154(b) by 143 days.

(21) Appl. No.: 18/515,747

(22) Filed: Nov. 21, 2023

(51) Int. Cl.
*E02D 5/76* (2006.01)
*E02D 5/80* (2006.01)

(52) U.S. Cl.
CPC ..... *E02D 5/80* (2013.01)

(58) Field of Classification Search
CPC .. E02D 5/80; E02D 5/801; E02D 5/74; E02D 5/76; E02D 5/765
See application file for complete search history.

(56) References Cited

U.S. PATENT DOCUMENTS

| | | | | |
|---|---|---|---|---|
| 891,448 | A | 6/1908 | Snider | |
| 2,603,319 | A | 7/1952 | Dyche | |
| 3,148,739 | A | 9/1964 | Mattingly et al. | |
| 3,343,612 | A | 9/1967 | Flowers | |
| 4,334,392 | A | 6/1982 | Dziedzic | |
| 4,858,876 | A * | 8/1989 | Moreno | E04H 12/2223 248/548 |
| 4,998,849 | A | 3/1991 | Summers | |
| 6,334,281 | B1 * | 1/2002 | Oliver | E02D 5/801 52/157 |
| 8,631,627 | B2 | 1/2014 | Atchley | |
| 8,721,226 | B2 | 5/2014 | Baumsteiger | |
| 9,051,706 | B1 | 6/2015 | Ludwig | |
| 9,127,513 | B2 * | 9/2015 | Matthias | E21B 17/046 |
| 9,512,589 | B1 * | 12/2016 | Van Polen | E02D 7/22 |
| 9,725,962 | B2 * | 8/2017 | Fischer | E21B 17/03 |
| 10,006,185 | B2 | 6/2018 | Tomchesson et al. | |
| 10,024,019 | B1 | 7/2018 | Hunter | |
| 10,077,893 | B1 | 9/2018 | Abraham | |
| 10,590,619 | B2 | 3/2020 | Ronnkvist | |

(Continued)

FOREIGN PATENT DOCUMENTS

| | | |
|---|---|---|
| DE | 202004003022 U1 | 6/2004 |
| KR | 101986458 B1 | 6/2019 |

OTHER PUBLICATIONS

"Orange Screw The ScrewDriver 2.0, Use With Orange Screw Ground Anchors For Easy & Quick Installation," publication date unknown, 10pp., retrieved on Sep. 7, 2023 from: https://www.amazon.com/Orange-Screw-ScrewDriver-Anchors-Installation/dp/B0BPB4FJCX?ref_=ast_sto_dp.

(Continued)

*Primary Examiner* — Chi Q Nguyen
(74) *Attorney, Agent, or Firm* — Law Office of Sam Sokhansanj PLLC

(57) ABSTRACT

A ground anchor and adapter system that can include an adapter or a driver, wherein the adapter or driver includes one or more protruding members. In addition, the system can include an anchor having one or more openings, and wherein the one or more openings of the anchor are adapted to receive the one or more protruding members of the adapter or driver. In addition, the adapter or driver can include a central bore, wherein the central bore includes a hexagonal pattern. Further, the adapter or driver can include a first plate having a plurality of cut-outs. In addition, the adapter or driver can include an outer shroud having a plurality of arched members.

17 Claims, 7 Drawing Sheets

(56) References Cited

U.S. PATENT DOCUMENTS

| | | | | |
|---|---|---|---|---|
| 11,015,635 | B2 | 5/2021 | Almy et al. | |
| 2007/0110521 | A1 | 5/2007 | Nimens | |
| 2014/0223854 | A1* | 8/2014 | Gilling | E21D 21/0086 52/745.21 |
| 2015/0218772 | A1* | 8/2015 | Shin | E02D 5/54 52/165 |
| 2017/0198453 | A1 | 7/2017 | Brown et al. | |
| 2020/0115874 | A1 | 4/2020 | Mar et al. | |
| 2020/0248424 | A1* | 8/2020 | Hudson | F24S 25/12 |
| 2022/0356724 | A1* | 11/2022 | Bergman | E04H 12/2223 |

OTHER PUBLICATIONS

Torsional-Tools, "Hydraulic equipment Torsion," publication date unknown, 8 pp., retrieved on Nov. 21, 2023 from: https://torsion-trade.com.

Krinner, "Krinner ground screw drivers," publication date unknown, 6 pp., retrieved on Nov. 21, 2023 from: https://www.krinner.io/en/foundation-construction/ground-screw-drivers/.

American Ground Screw, "Ground Anchor," publication date unknown, retrieved on Nov. 21, 2023 from: https://www.americangroundscrew.com/.

* cited by examiner

GROUND ANCHOR AND ADAPTER SYSTEM

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Ground or earth anchors are commonly used to secure various types of structures to the ground, such as buildings, fence posts, support beams, or light poles, among others. The conventional method of installing ground anchors can include digging a borehole, positioning, or driving the anchor within the borehole, and pouring concrete within the borehole and in and around the anchor in order to secure the anchor to the ground. Further, driving the anchor into the ground may involve affixing the anchor to an auger type system via several bolts and then decoupling the anchor from the auger once the anchor has been driven into the ground, which can be a time-consuming and labor-intensive process. Moreover, since conventional anchors have concrete poured in and around them, they cannot be readily or easily removed once installed at a location. Hence, the installation of conventional ground anchors are typically a permanent solution, cost-prohibitive in some instances, time-consuming, and labor-intensive to install.

Hence, what is needed is a ground anchor and adapter system that allows for temporary or permanent installation of multiple anchors that is not only cost-effective, requires minimal effort, and is simple and easy to install in a short period of time.

BRIEF SUMMARY

In one aspect of the present disclosure described herein, a ground anchor and adapter system is disclosed that allows for temporary or permanent installation of multiple anchors that is not only cost-effective, requires minimal effort, and is simple and easy to install in a short period of time, among other advantages. Here, the ground anchor and adapter system can include an adapter or a drive adapter, wherein the adapter includes one or more protruding members. In addition, the system can include an anchor having one or more openings, and wherein the one or more openings of the anchor are adapted to receive the one or more protruding members of the adapter. In addition, the adapter can include a central bore, wherein the central bore includes a hexagonal pattern. Further, the adapter can include a first plate having a plurality of cut-outs. Also, the adapter can include an outer shroud having a plurality of arched members. In addition, the plurality arched members can be spaced apart from each other and perpendicular relative to the plate. Also, the first plate can include a plurality of protruding members extending from below. Here, the plurality of protruding members can each include a tapered distal end. In addition, the anchor can include a plurality of openings configured in a radial or concentric pattern. Also, at least two of the plurality of openings can each be adapted to receive a protruding member of the adapter.

In another aspect of the present disclosure described herein, a ground anchor and driver system is disclosed. The system can include a driver having a plurality of protruding members extending therefrom. In addition, the system can include an anchor having a plate with a plurality of openings configured in a radial pattern, wherein the plurality of openings of the anchor are adapted to receive the plurality of protruding members of the adapter therein, such that the driver engages the anchor. In addition, the driver can include a central bore adapted to receive an auger mount therein. Further, the central bore can include a hexagonal pattern. Also, the driver can include a plate having a plurality of arcuate cut-outs around its perimeter. Moreover, the driver can include an outer cover having of a plurality of arched members. Also, the plurality arched members can be equally spaced apart from each other. In addition, the first plate can include a plurality of protruding members extending from below. Here, the plurality of protruding members can each include a tapered distal end. Further, the anchor can include a plurality of openings configured in a radial or concentric pattern.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
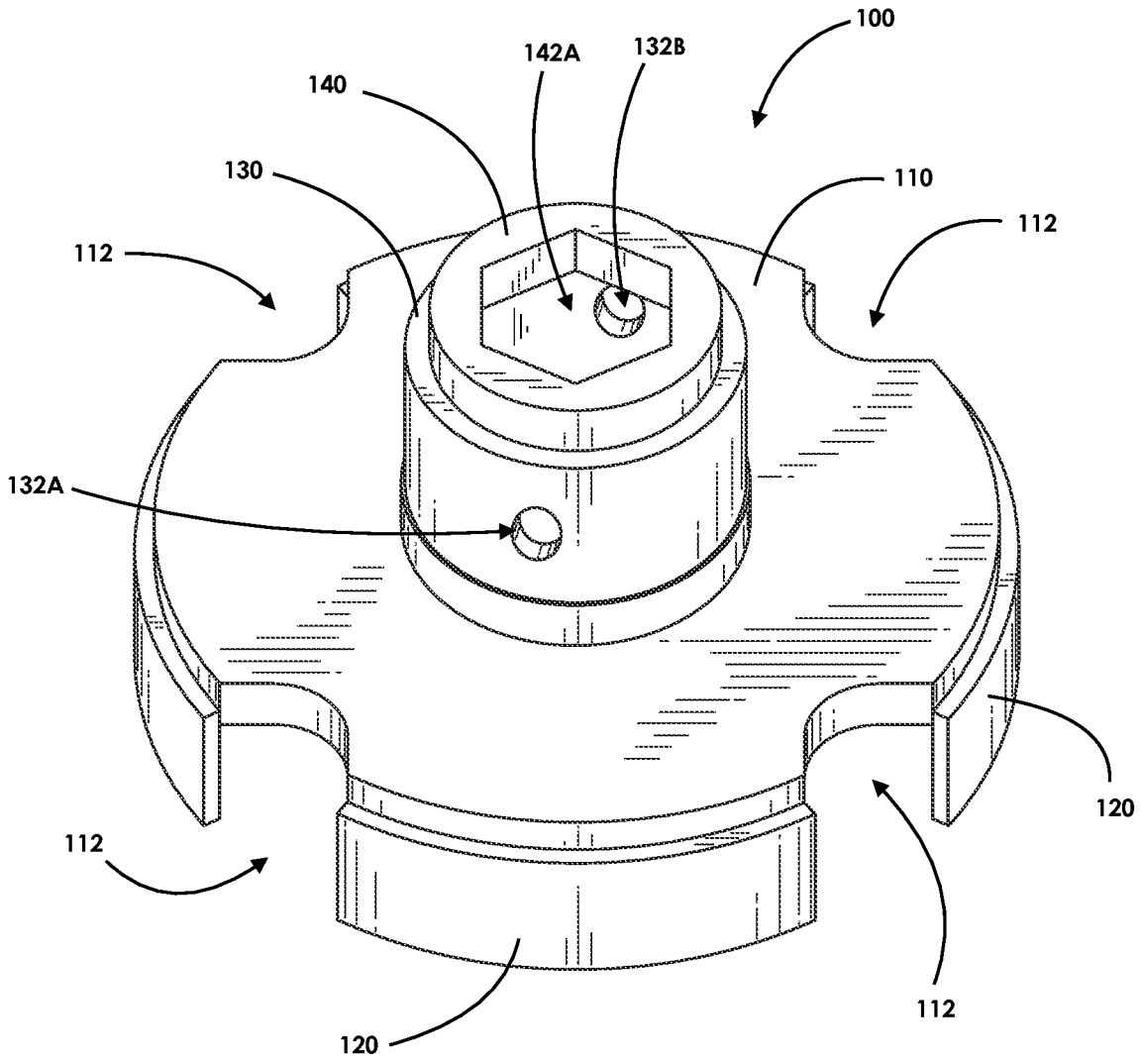
FIG. 1 illustrates a perspective top view of an adapter for the present disclosure described herein, according to one non-limiting exemplary embodiment.
Figure 2A:
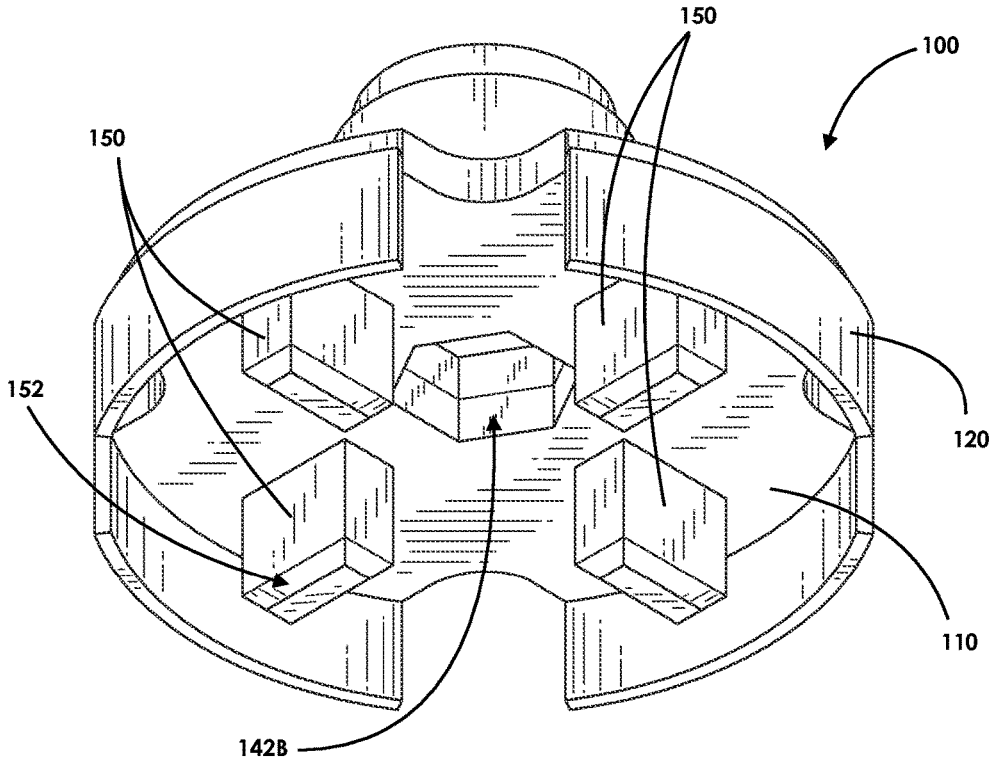
FIG. 2A illustrates a perspective bottom view of the adapter of FIG. 1.
Figure 2B:
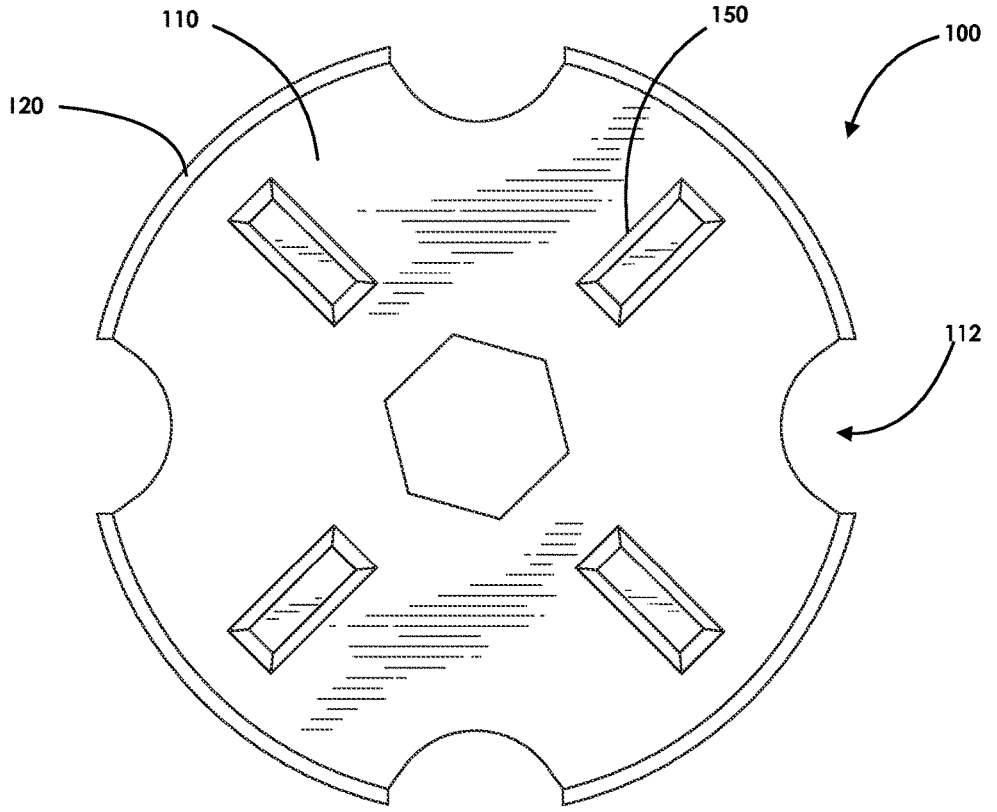
FIG. 2B illustrates a bottom view of the adapter of FIG. 1.

FIGS. 1-2B illustrate one non-limiting exemplary embodiment of an adapter 100 of the present disclosure described herein. As used herein, adapter 100 may also be referred to as any type of driver, drive adapter, socket, or holder for applying downward and/or torsional force to another member being driven by the adapter, such as an anchor, beam, post, screw, bolt, or any elongated member having a shaft, shank, head, and/or threads. Here, adapter 100 is shown having a plate 110 that further includes a plurality of cut-away regions or cut-outs 112 around its perimeter, such as four (4) cut-outs 112 equally spaced apart from each other in a radial or concentric pattern. Here, each cut-out 112 can include arched or half-moon shape configurations. In some embodiments, cut-outs 112 are stamped or pierced after formation of plate 110. In addition, anchor 100 can include a side wall or outer shroud 120 secured to its perimeter having multiple arched members equally spaced apart from each other and perpendicular to plate 110. Specifically, shroud 120 can be comprised of one unitary ring-shaped component that is welded unto the outer edge or lip of plate 110 and then cut in order to form cut-outs 112 and the individual arched members. Alternative, plate 110 and shroud 120 (and each associated arched member) are independently cut and then affixed or welded to each other, such as the four (4) independent arched members of shroud 120 affixed or welded onto plate 110. Alternatively, plate 110 and shroud 120 can be one unitary component and stamped from one mold.

Figure 4:
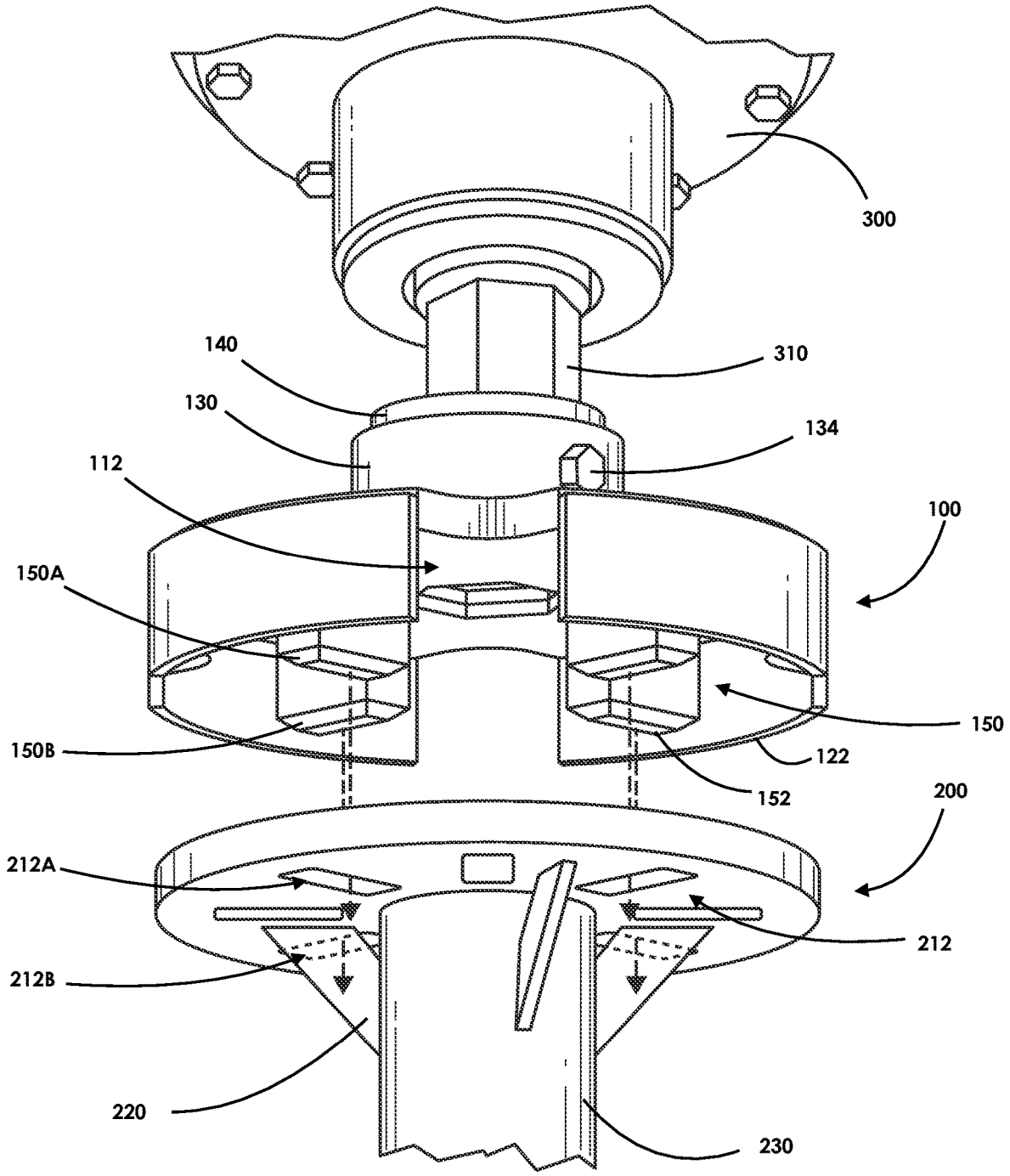
FIG. 4 illustrates a perspective bottom view of the adapter and anchor of the present disclosure described herein, shown in the process of being coupled together, according to one non-limiting exemplary embodiment.

Still referring to FIGS. 1-2B, plate 110 can further include a cylindrical member 130 secured to its top exterior surface. In addition, member 130 include aperture 132A and 132B stamped or pierced therethrough to allow a bolt to be slid through apertures 132A and 132B in order to secure the adapter to an auger mount 310, such as shown in FIG. 4. Further, another cylindrical member 140 can be affixed to member 130, wherein member 140 includes central bore opening having a hexagonal pattern cut-out opening 142A for receiving a corresponding male hexagonal arm or mount 310 from the auger 300, such as also shown in FIG. 4. In addition, as shown in FIGS. 2A-2B, the bottom region of plate 110 also includes a corresponding hexagonal pattern cut-out opening 142B that extends to opening 142A through the central bore, allowing a distal end of mount 310 to be secured within opening 142B as well. Accordingly, mount 310 can be removably secured to adapter 100 via the hexagonal shaped mount 310 disposed within openings 142A and 142B. In addition, mount 310 is further secured to adapter 100 via a bolt 134 that further passes through an opening of mount 310 and secures to both ends of openings 132A and 132B, such as via a nut/washer (not shown) secured to a distal end of bolt 134. It is contemplated within the scope of the present disclosure described herein that cut-outs 142A and 142B may be of any shape, size, or configuration that corresponds to a shape, size, or configuration of mount 310 (which may also have any configuration or pattern). For example, cut-outs 142A and 142B may have a square, triangular, octagonal, pentagonal, asymmetrical, or any configuration that allows mount 310 to be slidably and securely received therein, thus allowing mount 310 connected to auger 300 to rotate and drive adapter 100. The foregoing system allows for adapter 100 to be quickly and easily secured to and removed from mount 310, among other advantages.

Figure 3A:
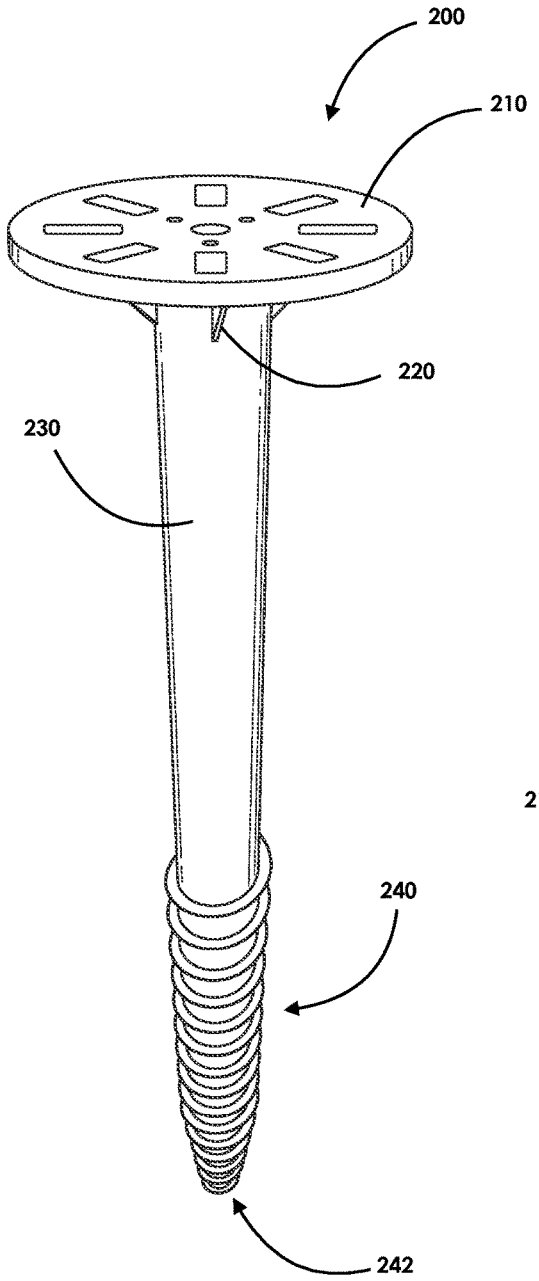
FIG. 3A illustrates a perspective side view for an anchor of the present disclosure described herein, according to one non-limiting exemplary embodiment.
Figure 3B:
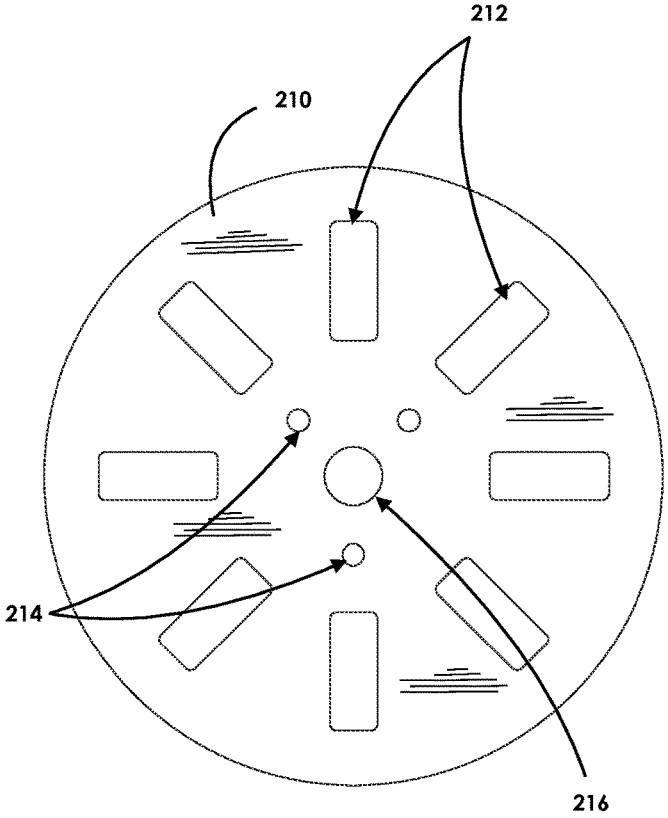
FIG. 3B illustrates a top view for the anchor of FIG. 3A.

Referring to FIGS. 1-4, adapter 100 can also include a plurality of protruding members, teeth, prongs, or protrusions 150 that are affixed or welded onto plate 110 of adapter 100 for engaging corresponding openings 212 of anchor 200, such as shown in FIGS. 3A-4. It is contemplated within the scope of the present disclosure described herein that plate 110 may include any number of protrusions 150, preferably four (4) protrusions 150. Here, each protrusion 150 includes a beveled or tapered distal end 152 with a flat bottom surface. Each protrusion is adapted to have vertical height of about 2.5 to 3 in.; however, it is contemplated within the scope of the present disclosure described herein each protrusion 150 may have any height, length, width, or depth depending on the application. In addition, as shown in FIG. 4, the distal end face 152 of each protrusion 150 is configured such that it does not extend past the bottom end face 122 of each arched member of shroud 120. The tapered end 152 of each protrusion 150 allows it to more easily locate and slide within corresponding openings 212 of anchor 200. Referring to FIGS. 3A-4, in one embodiment, plate 210 of anchor 200 is shown having at least eight (8) openings 212. However, protrusions 150 may only engage four (4) openings 212 of anchor 200, thus allowing more latitude or freedom for an operator of the auger 300 to position the adapter 100 over plate 210 of anchor 200 in order to align protrusions 150 with some of the openings 212 of anchor 200. In addition, as shown in FIGS. 4-5, openings 112 on adapter 100 allow an operator to readily view where plate 210 (and its openings 212) are relative to protrusions 150 and that the top of plate 210 is fully engaged with the bottom of plate 110 as the operator lowers the adapter onto plate 210 of anchor 200 to engage it.

Referring back to FIGS. 3A-3B, ground anchor 200 is shown having a head, mount, or plate 210 that is affixed or welded onto a proximal end of shank or shaft 230, wherein shaft 230 further includes a plurality of helical threads 240 for being driven into earth in a clockwise direction. In addition, plate 210 can be further supported and secured to shaft 230 via support members or brackets 220, such as four (4) brackets evenly spaced apart from each other in a radial pattern. As shown, plate 210 can include a plurality of openings 212 evenly spaced apart from each and disposed in a radial or concentric pattern. In one embodiment, at least four (4) openings 212 are adapted to receive therethrough four (4) protrusions 150 from adapter 100, such that adapter 100 is fully engaged with plate 210. In addition, as shown in FIGS. 7B-7C, openings 212 are further adapted to receive a fastener, such as bolt 600, therethrough in order to operate as a mount for securing another plate or object (such as a mounting plate/face of a pole, post, building column, or support column) thereto. In addition, plate 210 also include openings 214 and opening 216. Further, anchor 200 can include an opening 242 on its distal end tip. Here, opening 216 can allow fluids (such as water) to be poured down the anchor to assist with lubrication via opening 242, such that the fluid dispenses or exits out from opening 242 in order to soften the surrounding soil.

Figure 5:
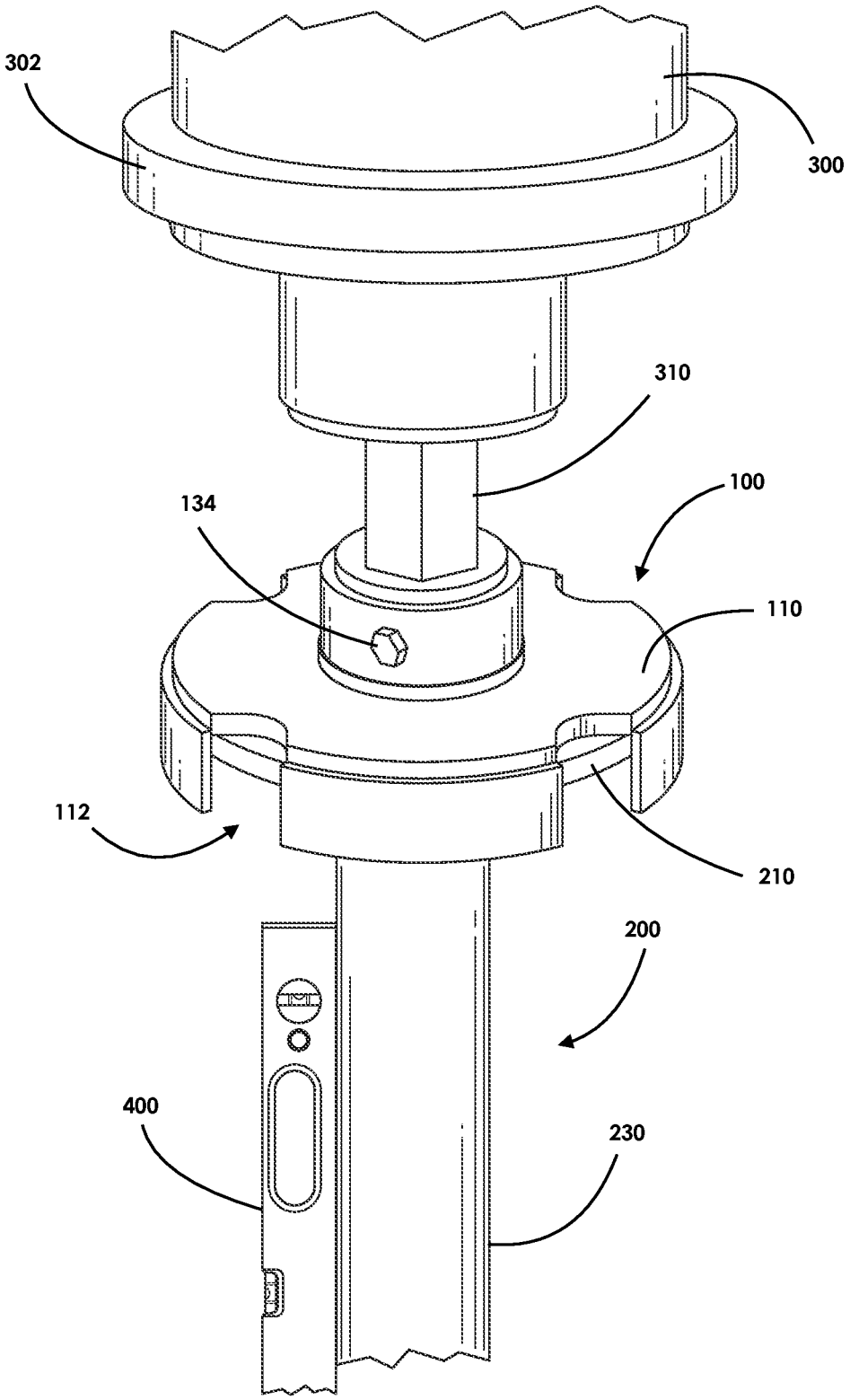
FIG. 5 illustrates a perspective top view of the adapter secured to an auger and further engaged with the anchor of the present disclosure described herein, according to one non-limiting exemplary embodiment.
Figure 6A:
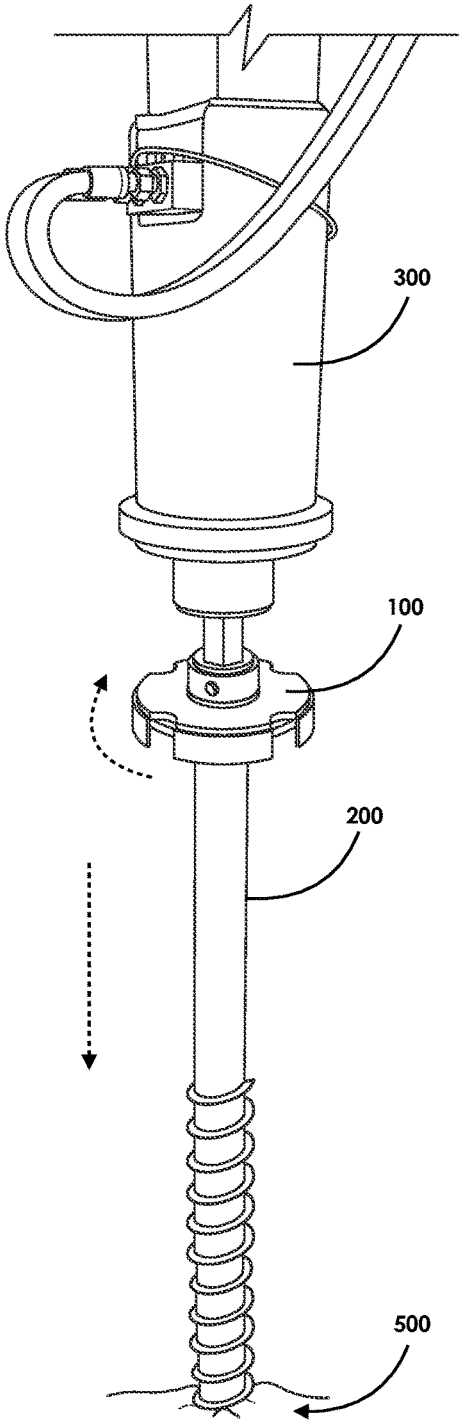
FIGS. 6A-6B illustrate perspective views of the auger and adapter operating to drive the anchor of the present disclosure described herein into the ground, according to one non-limiting exemplary embodiment.
Figure 6B:
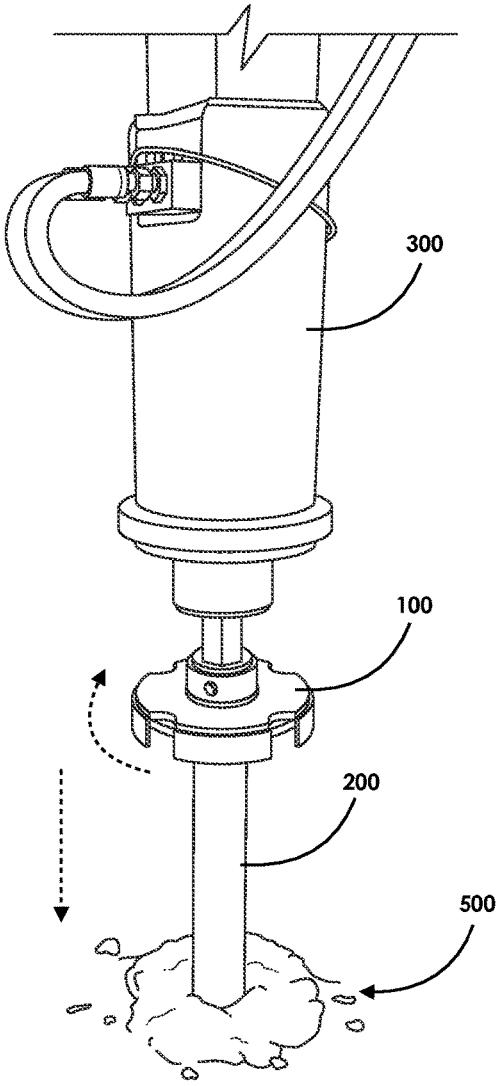

Referring to FIGS. 5-6, a hydraulic or motorized auger 300 having a male member adapter, arm, extension, or mount 310 is shown secured to adapter 100, and adapter 100 further secured to anchor 200 for driving the anchor into earth 500. Specifically, as shown in FIG. 4 for exemplary purposes, protrusion 150A can engage opening 212A and protrusion 150B can engage opening 212B of plate 210. Once adapter 100 is fully engaged with plate 210, such as shown in FIG. 5, then anchor 200 can be positioned such that is level relative to the ground. Specifically, a liquid or magnetic level apparatus 400 may be removably secured to the non-threaded body of shank 230 such that an operator of the auger 300 can visually see if anchor 200 is level while it is being driven into the ground in a clockwise direction. As anchor 200 is being driven into earth, the operator of the auger 300 may need to periodically adjust the position of the adapter 100 (while it's engaged and secured to anchor 200) such that anchor 200 is level with the ground. Alternatively, in other embodiments, auger 300 may include a level meter having indicia or visible indicators (such as lighting) to indicate that the auger 300 is level with the ground, and the operator can make corresponding changes to the position of the auger as needed such that the anchor is level or perpendicular to earth. However, it is contemplated within the scope of the present disclosure described herein that any other components in lieu of a motorized or hydraulic auger may be used to drive the adapter and anchor of the present disclosure described herein, including but not limited to manual hand tools, powered drills, or any machine or tool that can generate rotation or torsional force.

Figure 7A:
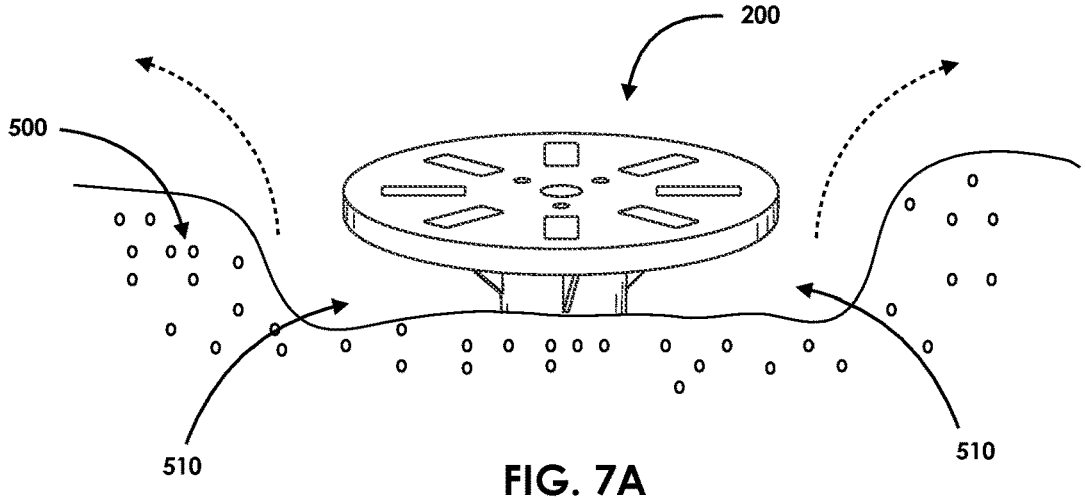
FIGS. 7A-7C illustrates simplified side views of the anchor installed into the ground and a process for removing the surrounding earth in order to secure one or more fasteners to the anchor, according to one non-limiting exemplary embodiment.
Figure 7B:
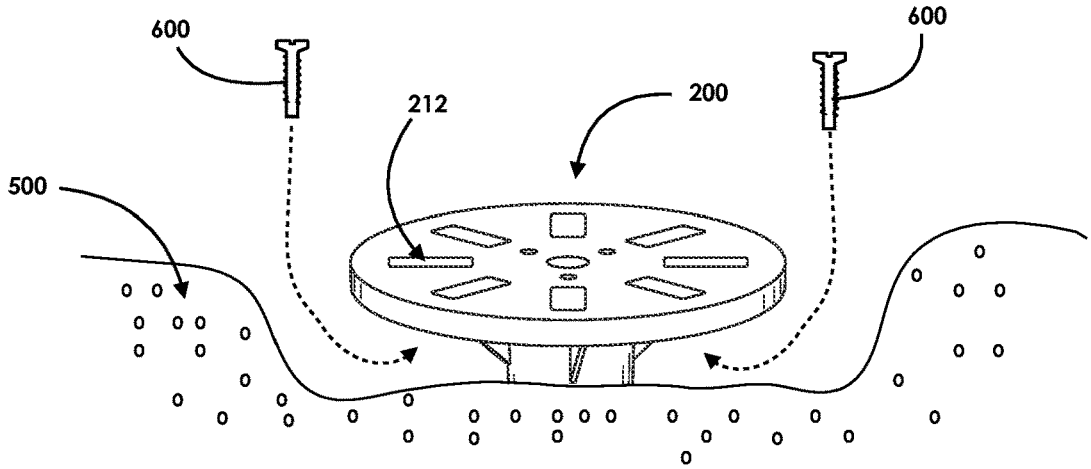
Figure 7C:
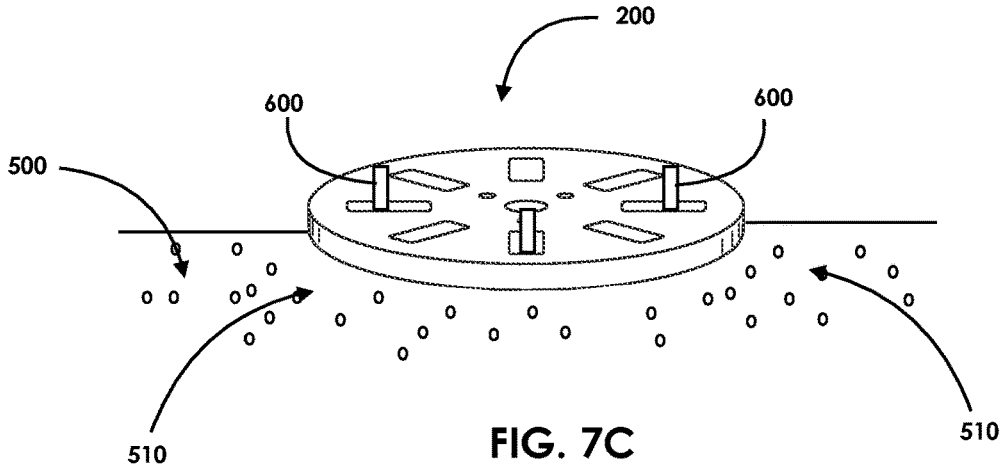

Referring to FIGS. 7A-7C, one embodiment for a method of securing fasteners to plate 210 of anchor 200 is shown. For example, once anchor 200 has been driven fully (or at least partially) into the ground 500 via adapter 100, the adapter 100 (and its protrusions) can then disengage plate 210 of anchor 200. Here, it is noted that once anchor 200 has been rotationally driven fully into the ground, the rotation of shroud 120 of adapter 100 engaging the earth allows the adapter to clear dirt away from the surrounding perimeter area of plate 210 of anchor 200. Next, an operator may clear the dirt away from below and around plate 210 of anchor 200, such as shown in FIG. 7A. In particular, as shown in FIGS. 7A-7B, a crater or opening 510 can be created in the ground below and around plate 210 such that one or more fasteners 600 (such as bolts) can be placed under the plate and slid through one or more of its openings 212, wherein fasteners 600 are disposed in an inverted position. Once fasteners 600 are positioned or secured to plate 210, the remaining dirt can be packed back into the crater or opening below and around plate 210. Next, any type of mounting plate (not shown) for an object, such as a light pole, support column, or post, can be secured to the top of plate 210 and further secured to fasteners 600.

It is contemplated within the scope of the present disclosure described herein that anchor 200 can also be easily removed by having the adapter 100 re-engage plate 210 and reverse the rotational operation of the auger 300 (e.g., in a counter-clockwise direction) in order to remove the anchor 200 from the ground. Further, it is contemplated within the scope of the present disclosure described herein that adapter 100 and anchor 200 (including any associated components) may be made of any material or thickness, preferably steel. For example, such materials can include various types of carbon steel, alloy steel, stainless steel, and tool steel, among others.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. A ground anchor and adapter system, comprising:

an adapter;

the adapter comprising a plurality of protruding members, wherein the adapter comprises a plate, wherein the plurality of protruding members extend from below the plate, and wherein the plurality of protruding members each comprise a tapered distal end;

an anchor comprising a plurality of openings; and wherein the one or more openings of the anchor are adapted to receive the one or more protruding members of the adapter.

2. The ground anchor and adapter system of claim 1, wherein the adapter comprises a central bore.

3. The ground anchor and adapter system of claim 2, wherein the central bore comprises a hexagonal pattern.

4. The ground anchor and adapter system of claim 1, wherein the adapter comprises a plate having a plurality of cut-outs.

5. The ground anchor and adapter system of claim 1, wherein the adapter comprises an outer shroud comprised of a plurality of arched members.

6. The ground anchor and adapter system of claim 5, wherein the plurality arched members are spaced apart from each other.

7. The ground anchor and adapter system of claim 1, wherein the adapter comprises a plate, wherein the plurality of protruding members extend from below the plate.

8. The ground anchor and adapter system of claim 1, wherein the plurality of openings of the anchor are configured in a radial or concentric pattern.

9. The ground anchor and adapter system of claim 1, wherein at least two of the plurality of openings are each adapted to receive at least one of the one or more protruding member of the adapter.

10. A ground anchor and driver system, comprising:

a driver comprising a plurality of protruding members extending therefrom;

an anchor comprising a plate having a plurality of openings configured in a radial pattern; and wherein the plurality of openings of the anchor are adapted to receive the plurality of protruding members of the adapter therein, such that the driver engages the anchor.

11. The ground anchor and driver system of claim 10, wherein the driver comprises central bore adapted to receive an auger mount therein.

12. The ground anchor and driver system of claim 11, wherein the central bore comprises a hexagonal pattern.

13. The ground anchor and driver system of claim 10, wherein the driver comprises a plate having a plurality of arcuate cut-outs.

14. The ground anchor and driver system of claim 10, wherein the driver comprises an outer cover comprised of a plurality of arched members.

15. The ground anchor and driver system of claim 14, wherein the plurality arched members are equally spaced apart from each other.

16. The ground anchor and driver system of claim 10, wherein the driver comprises a plate, the plurality of protruding members extending from below the plate.

17. The ground anchor and driver system of claim 10, wherein the plurality of protruding members each comprise a tapered distal end.

* * * * *